US007034754B2

(12) United States Patent
Hung et al.

(10) Patent No.: US 7,034,754 B2
(45) Date of Patent: Apr. 25, 2006

(54) MULTI-BAND ANTENNA

(75) Inventors: Zhen Da Hung, Tu-Chen (TW); Lung-Sheng Tai, Tu-Chen (TW); Yun-Lung Ke, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/949,159

(22) Filed: Sep. 24, 2004

(65) Prior Publication Data

US 2005/0068234 A1 Mar. 31, 2005

(30) Foreign Application Priority Data

Sep. 26, 2003 (TW) ..... 92126628 A

(51) Int. Cl.
*H01Q 1/38* (2006.01)

(52) U.S. Cl. ..... 343/700 MS; 343/702

(58) Field of Classification Search ..... 343/700 MS, 343/702, 725, 728, 873, 848
See application file for complete search history.

(56) References Cited

U.S. PATENT DOCUMENTS

| | | | | |
|---|---|---|---|---|
| 6,147,652 | A | 11/2000 | Sekine | |
| 6,166,694 | A | 12/2000 | Ying | |
| 6,552,686 | B1 * | 4/2003 | Ollikainen et al. .. | 343/700 MS |
| 6,593,888 | B1 | 7/2003 | Fu | |
| 6,734,825 | B1 * | 5/2004 | Guo et al. ..... | 343/700 MS |
| 6,831,607 | B1 * | 12/2004 | Hebron et al. ..... | 343/700 MS |
| 6,836,249 | B1 * | 12/2004 | Kenoun et al. ..... | 343/700 MS |
| 6,897,810 | B1 * | 5/2005 | Dai et al. ..... | 343/700 MS |

FOREIGN PATENT DOCUMENTS

CN 2541958 Y 3/2003

* cited by examiner

*Primary Examiner*—Shih-Chao Chen
(74) *Attorney, Agent, or Firm*—Wei Te Chung

(57) ABSTRACT

A multi-band antenna (1) used for an electronic device includes a Z-shaped ground portion, a first L-shaped radiating arm (13) positioned above a ground section of the ground portion, a second U-shaped radiating arm (14) extending from the first radiating arm, a connecting portion (12) connecting the two radiating arms with the ground portion. The first and the second radiating arms are coplanar with each other. The ground portion, the connecting portion, the radiating arms and the feeder cable form two inverted-F antennas operating in different frequency bands.

23 Claims, 9 Drawing Sheets

MULTI-BAND ANTENNA

BACKGROUND OF THE INVENTION

1. Field of the Invention

The present invention relates generally to an antenna, and more particularly to a multi-band inverted-F antenna which can be used with an electronic device and allows the electronic device to communicate within different frequency bands.

2. Description of the Prior Art

With the development of wireless local area networks (WLANs) and wireless personal area networks (WPANs) in the recent years, many protocols or standards are developed to adapt to the newest wireless networks accompanyingly. 802.11b, 802.11g, HomeRF, Zigbee which appears in 2003 and is developing rapidly now, Bluetooth1.0, and Bluetooth 2.0 which is under research now all require a working frequency in 2.4 GHz band. Meanwhile, 802.11a which is put forward in 2000 and 802.11n which is still a plan now all require a working frequency in 5 GHz band.

To match the wireless networks requirement and the standards mentioned above, many portable terminals have employed a number of different types of antennas to receive and transmit signals over the air interface. As known, the development of multi-band antennas embedded in wireless network devices is a newest trend. For example, planar inverted-F antennas mounted perpendicularly to a conducting portion have been found to implement dual-band easily, and also have advantage of good radiation characteristics, simple construction and relatively light weight.

In nowadays, many multi-band planar inverted-F antennas solutions are put forward. For example, referring to FIG. 9, U.S. Pat. No. 6,166,694 discloses a built-in multi-band planar inverted-F antenna suitable for using in future compact mobile terminals comprising a dielectric substrate 320, an antenna feed pin 325, a grounded post 335, two spiral arms 305 and 310 operating in different frequency bands and a matching bridge 330 positioned between the feed pin 325 and the grounded post 335. The conventional antenna is a microstrip antenna designed especially to work on GSM, DCS and ISM frequency bands. However, though it appears as a multi-band antenna, there is still a hope of an antenna that can work at higher dual-frequency, especially both at 2.4 GHz and 5 GHz bands so as to apply in different wireless local or wireless personal area networks and doesn't raise price. Further more, because the conventional antenna is manufactured as printed circuit, the configuration of the antenna is not steady enough to stand the resistance test.

Hence, synthetically consider the factors of frequency, configuration, fixing, stability, and occupancy space, etc, an improved multi-band inverted-F antenna is desired to overcome the above-mentioned disadvantages of the prior art.

BRIEF SUMMARY OF THE INVENTION

A primary object, therefore, of the present invention is to provide a multi-band inverted-F antenna for operating in different frequency bands.

Another object, therefore, of the present invention is to provide an antenna made of sheet metal.

In order to implement the above objects and overcomes the above-identified deficiencies in the prior art, the multi-band antenna of the present invention used in an electronic device for electrically connecting with a feeder cable is made of sheet metal and comprises a Z-shaped ground portion which comprises a fixing section, a ground section and a vertical conducting plate, a first L-shaped radiating arm positioned above the ground section of the ground portion, a second U-shaped radiating arm extending from the first radiating arm, a connecting portion connecting the first and the second radiating arms with the ground portion, and a feeding point being arranged on the connecting portion. The first and the second radiating arms are coplanar with each other and cooperatively form an open loop which defines a gap in a corner therein and adjacent to the fixing section of the ground portion. The connecting portion, the first and the second radiating arms and the feeder cable form two inverted-F antennas operating in different frequency bands.

The present invention do not only economize the limit space of notebook computer, but also have good impedance matching. The whole multi-band antenna is made of sheet metal so that it can pass the panel vibrational test of an electronic device easily.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
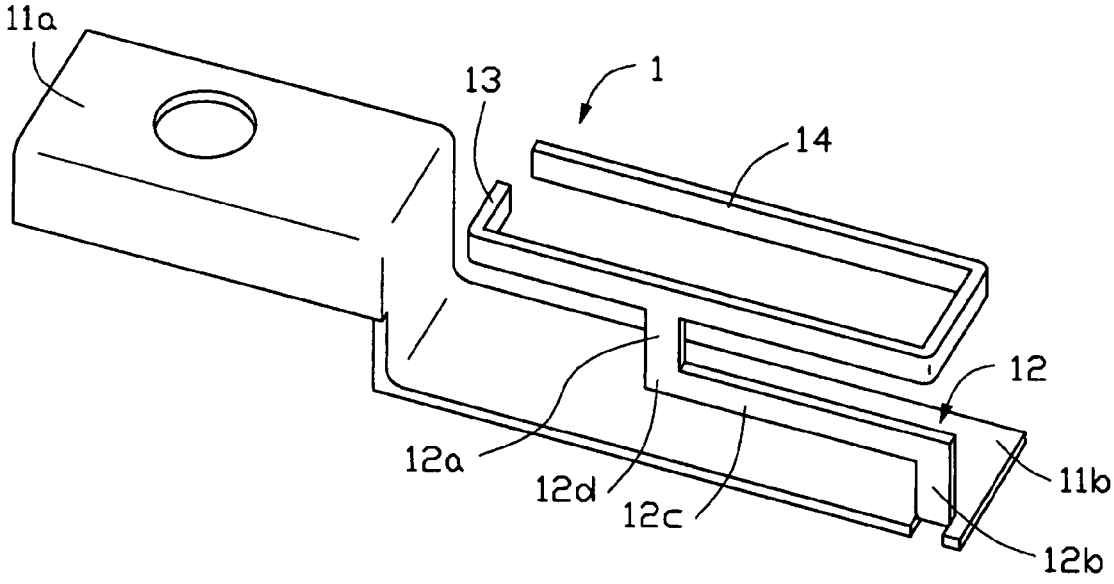
FIG. 1 is a perspective view of a preferred embodiment of a multi-band antenna in accordance with the present invention.

Referring to FIG. 1, a multi-band inverted-F antenna 1 according to the present invention is made of sheet metal and comprises a Z-shaped ground portion (not labeled), a step-shaped connecting portion 12, a first radiating arm 13 and a second radiating arm 14.

The Z-shaped ground portion comprises a fixing section 11*a* located on the left-hand side (as viewed from FIG. 1), a ground section 11*b* located on the right-hand side and a vertical conducting plate (not labeled) connecting the fixing section 11*a* and the ground section 11*b*. The fixing section 11*a* comprises a horizontal plane (not labeled) which is parallel to the ground section 11*b* and defines a circular screw hole (not labeled), and a vertical plane (not labeled) extending downwardly from the horizontal plane and perpendicular to the ground section 11*b*. The horizontal plane and the vertical plane are provided for cooperatively bundling on a complemental installation of an electronic device for securely fixing the antenna 1 in the electronic device (e.g. a notebook computer).

The step-shaped connecting portion 12 connects the first and the second radiating arms 13 and 14 with the ground section 11*b* and comprises an upper vertical portion 12*a*, a lower short circuit 12*b* and a horizontal portion 12*c*. The upper vertical portion 12*a* comprises an upper end at a junction of the two radiating arms 13 and 14. The short circuit 12*b* is perpendicular to and extends upwardly from a front edge of the ground section 11*b* and is far from the fixing section 11*a*. The upper vertical portion 12*a* and the short circuit 12*b* are connected through the horizontal portion 12*c*. The horizontal portion 12*c* is parallel to the longitudinal sides of the ground section 11*b*. A feeding point 12*d* is located at a joint of a lower end of the upper vertical portion 12*a* and the horizontal portion 12*c*. The feeding point 12*d* is provided for transmitting electrical signals that are fed into the antenna and/or for receiving electromagnetic wave that is fed into an electronic device. To conjugate the feeding point, a coaxial feeder cable (not shown) comprising an inner conductor and an outer conductor may be used. The inner conductor of the coaxial feeder cable is electrically connected to the feeding point 12*d*, and the outer conductor is electrically connected to the ground section 11*b*. By changing the position of the feeding point 12*d* on the horizontal portion 12*c*, the antenna performance can be improved. Tuning of an antenna refers to matching the impedance seen by an antenna at its input terminals such that the input impedance is seen to be purely resistive without appreciable reactive component.

Referring again to FIG. 1, the first and the second radiating arms 13 and 14 are situated above the ground section 11*b* and are of different lengths. The first radiating arm 13 is L-shaped, and is parallel to the ground section 11*b*. The second radiating arm 14 is substantially U-shaped, and is coplanar with the first radiating arm 13. The two radiating arms 13 and 14 are of the same height, and cooperatively form a substantially rectangular open loop with a gap in a corner thereof and adjacent to the fixing section 11*a*. One skilled in the art will appreciate that the current in the radiating arms travels from the feeding point 12*d* to the ends of the radiating arms 13 and 14. By controlling the lengths of the radiating arms 13 and 14, the operating frequencies of the antenna 1 can be adjusted. The length of the first radiating arm 13 is generally a quarter wavelength of the higher frequency band so as to be resonant at frequencies in a first higher band. The second radiating arm 14 is of a length generally a quarter to the wavelength of the lower frequency band so as to be resonant at frequencies in a second lower band. The two radiating arms 13 and 14 can be made resonant at any frequency.

Figure 2:
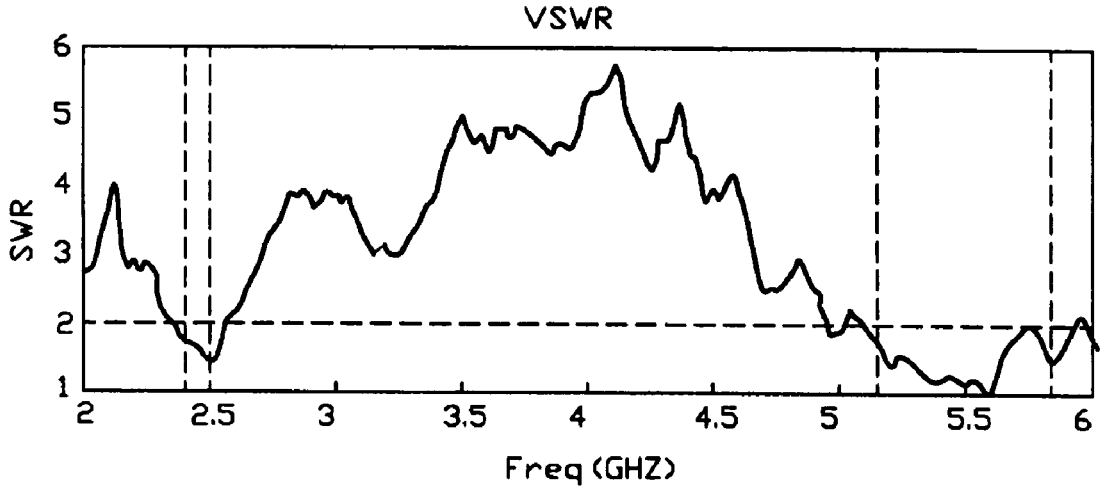
FIG. 2 is a test chart recording of Voltage Standing Wave Ratio (VSWR) of the multi-band antenna as a function of frequency.
Figure 3:
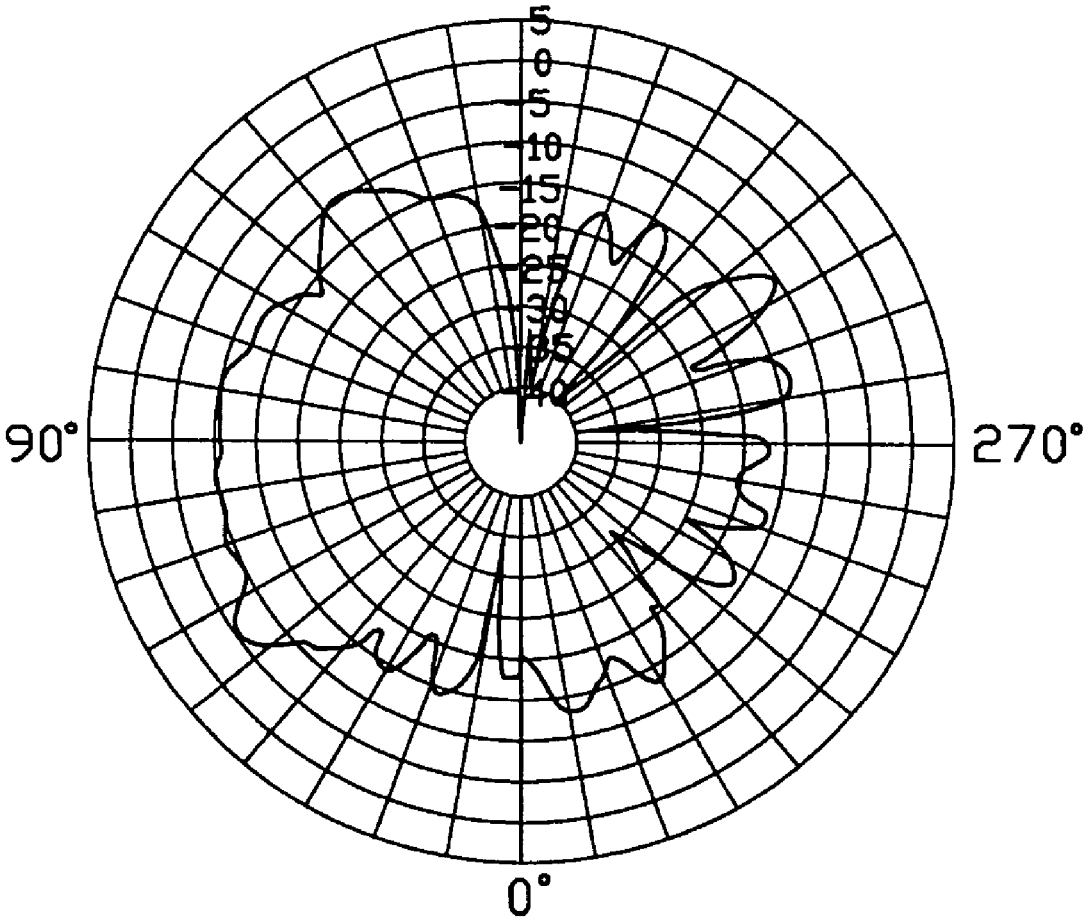
FIG. 3 is a horizontally polarized principle plane radiation pattern of the multi-band antenna operating at the frequency of 2.5 GHz.
Figure 4:
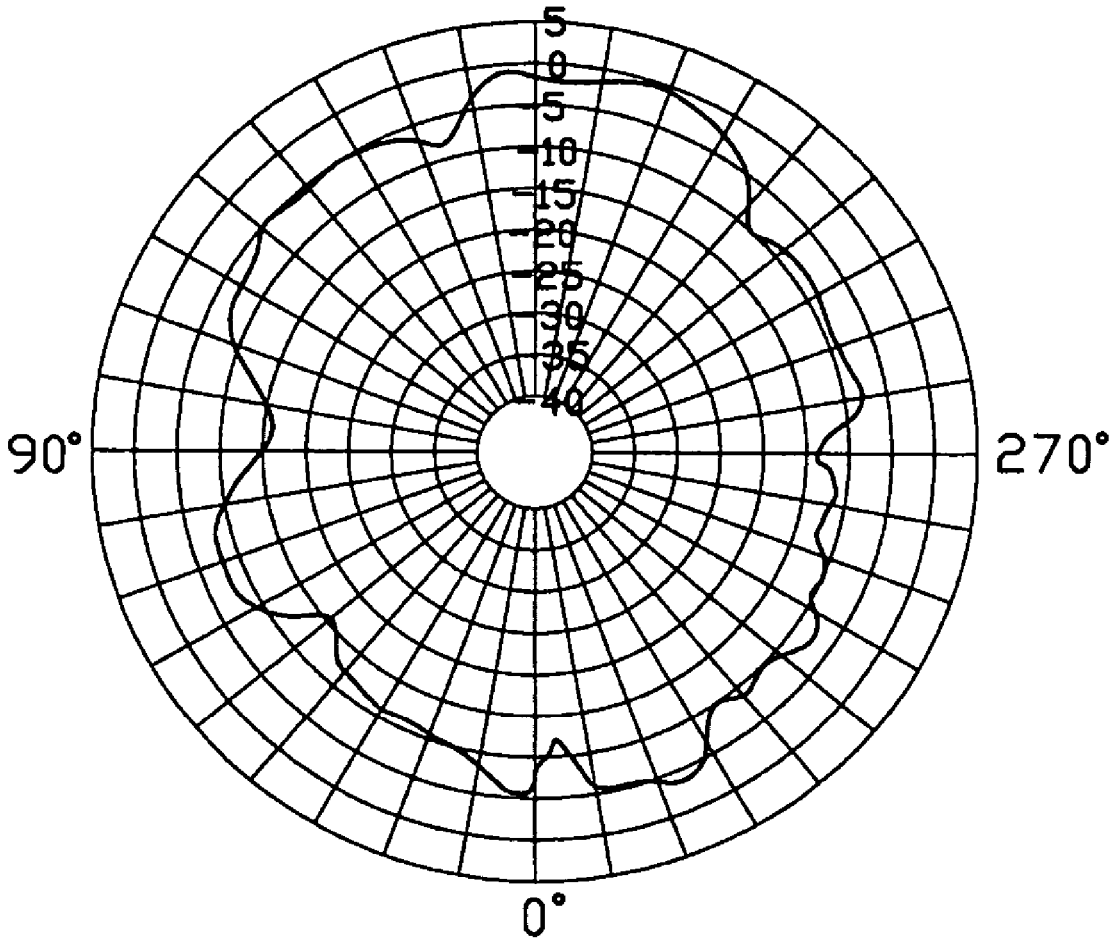
FIG. 4 is a vertical polarized principle plane radiation pattern of the multi-band antenna operating at the frequency of 2.5 GHz.
Figure 5:
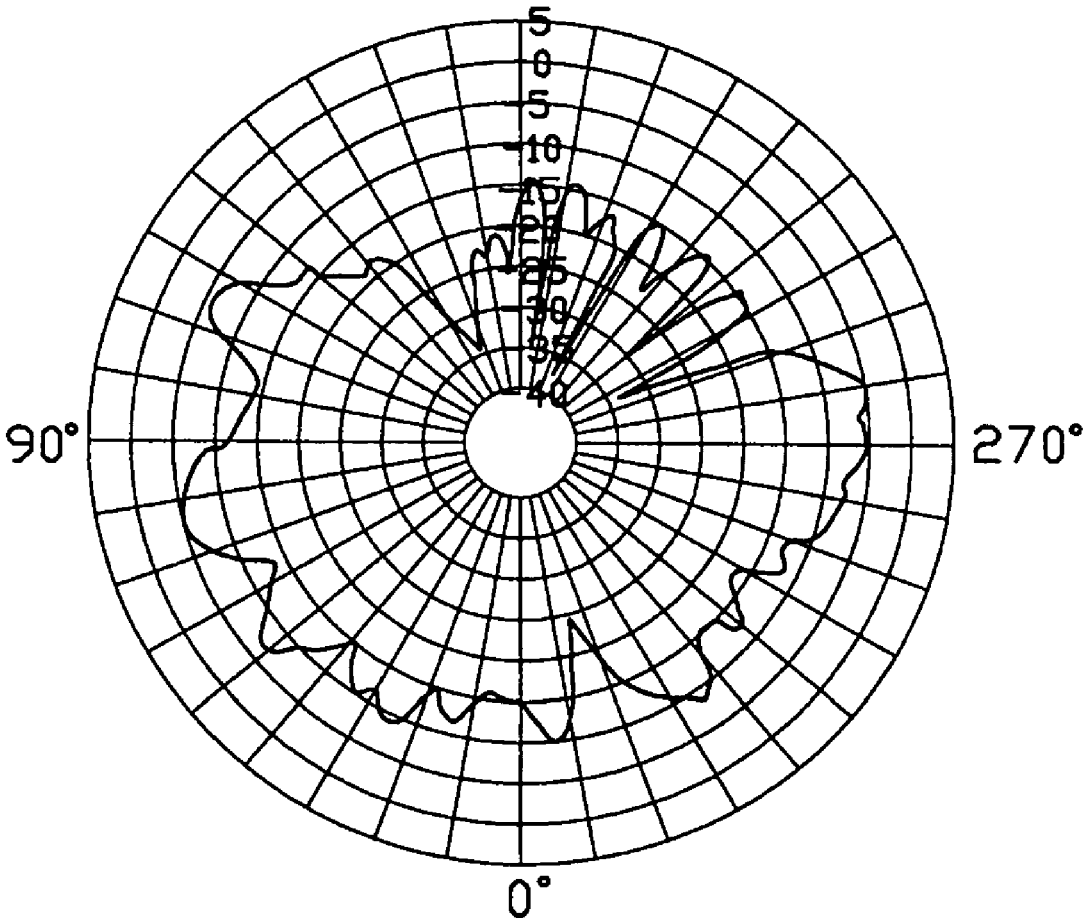
FIG. 5 is a horizontally polarized principle plane radiation pattern of the multi-band antenna operating at the frequency of 5.35 GHz.
Figure 6:
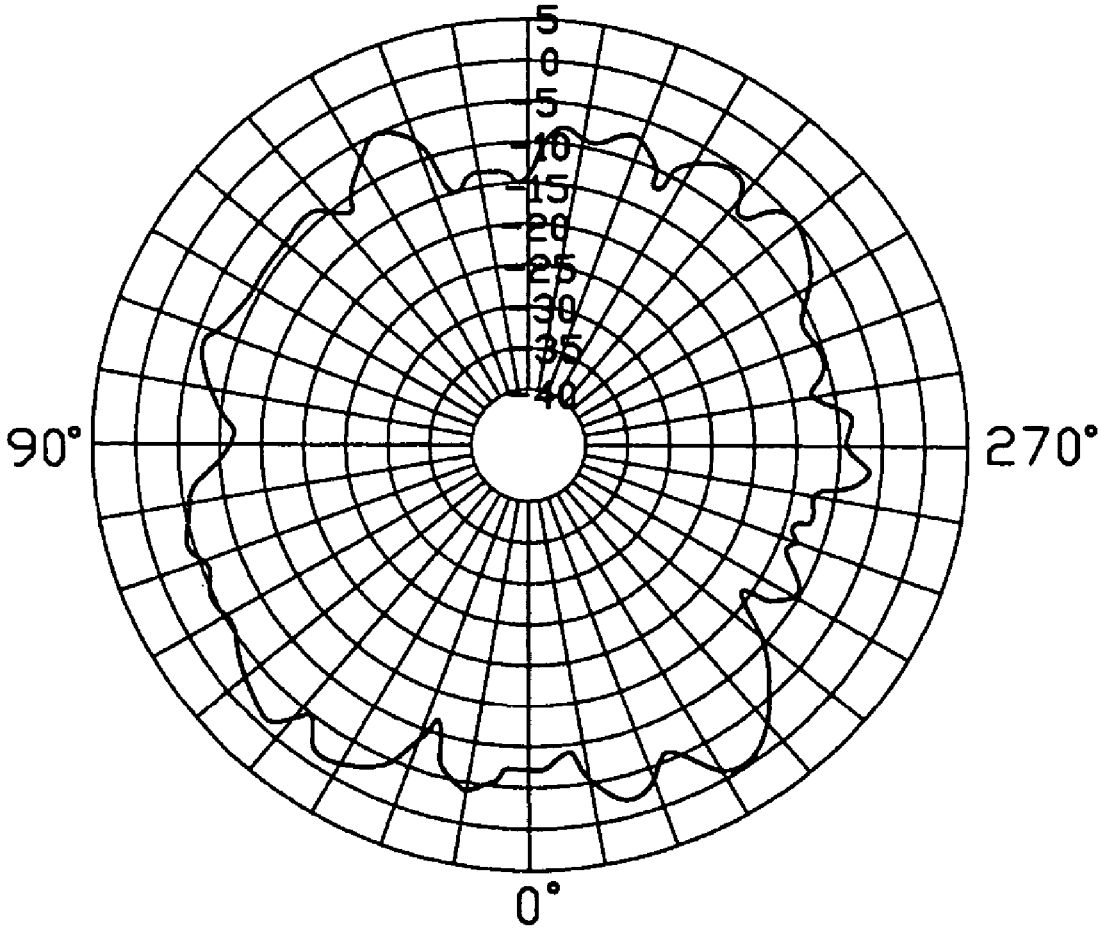
FIG. 6 is a vertical polarized principle plane radiation pattern of the multi-band antenna operating at the frequency of 5.35 GHz.
Figure 7:
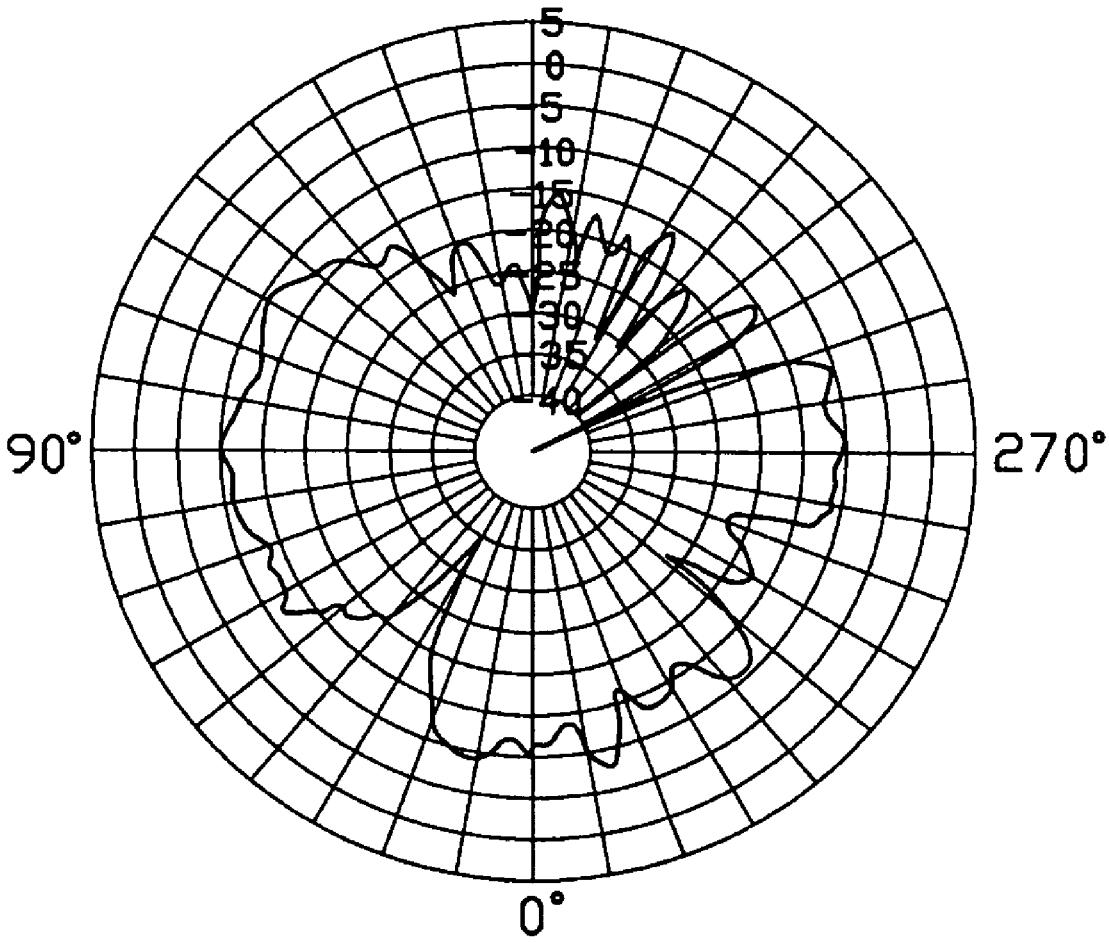
FIG. 7 is a horizontally polarized principle plane radiation pattern of the multi-band antenna operating at the frequency of 5.725 GHz.
Figure 8:
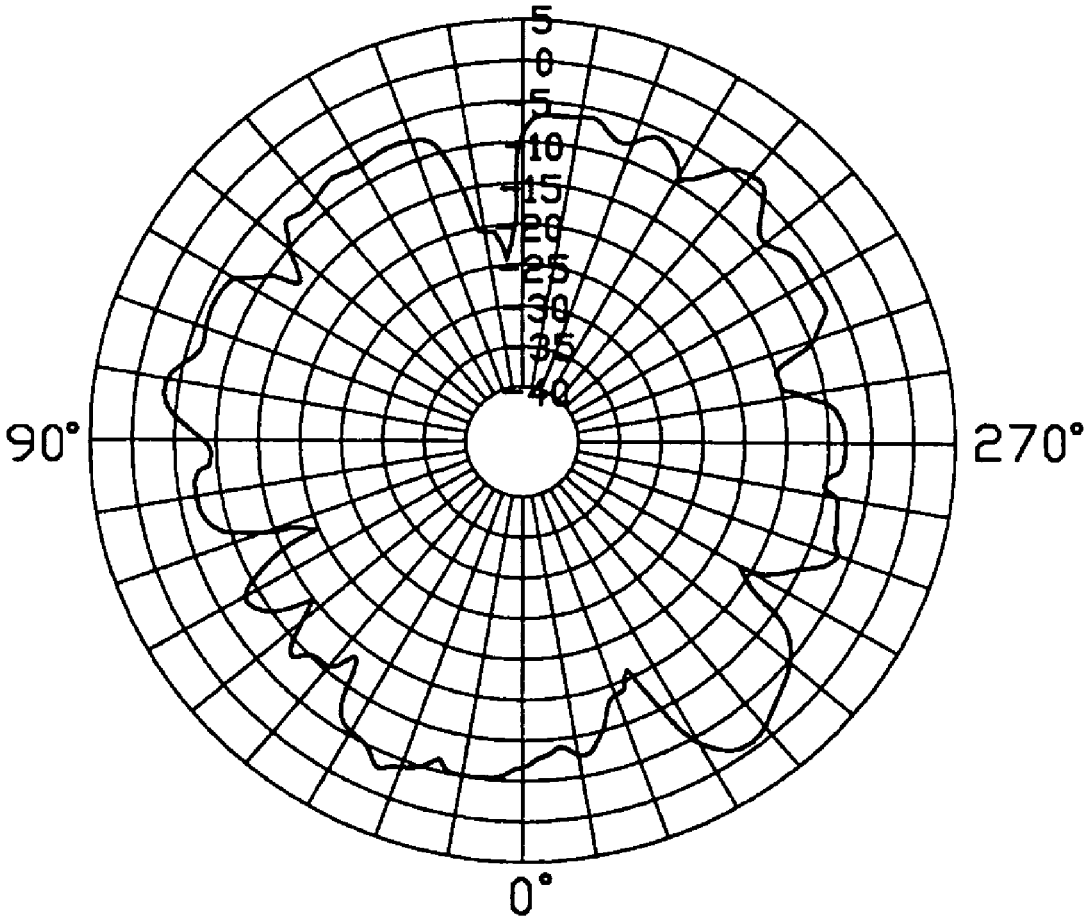
FIG. 8 is a vertical polarized principle plane radiation pattern of the multi-band antenna operating at the frequency of 5.725 GHz.
Figure 9:
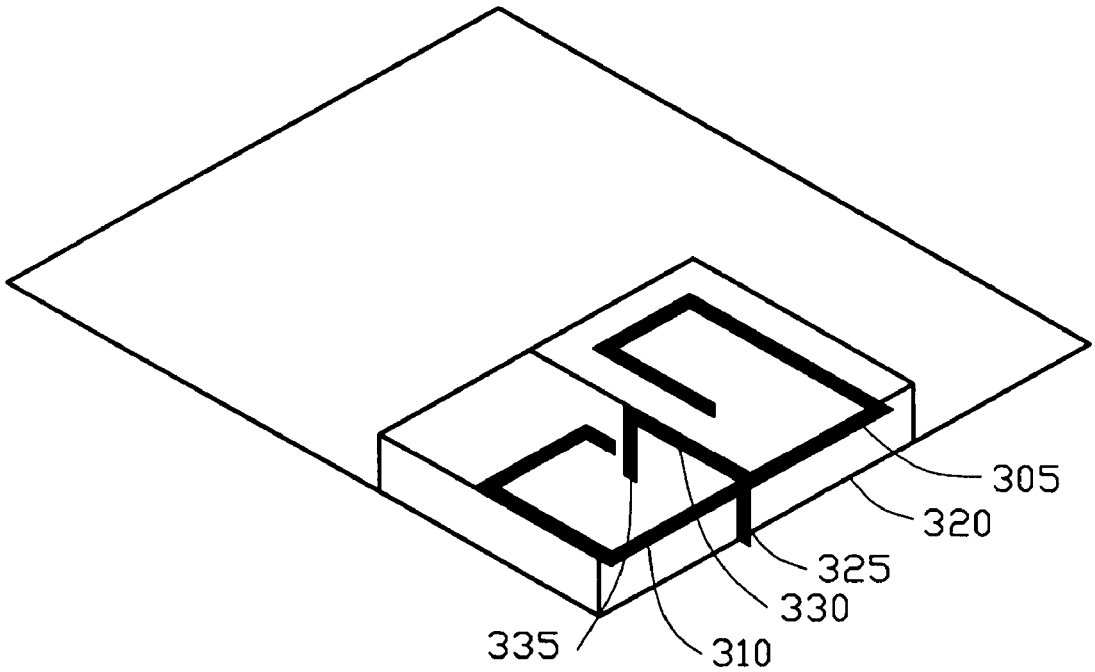
FIG. 9 (PRIOR ART)
FIG. 9 is a perspective view of a conventional antenna.

In terms of this preferred embodiment, the total length of the two radiating arms 13 and 14 is less than 20 mm, but the bandwidth characteristic of the present antenna 1 performs under a wide range. In order to illustrate the effectiveness of the present invention, FIG. 2 sets forth a test chart recording of Voltage Standing Wave Ratio (VSWR) of the multi-band antenna 1 as a function of frequency. Note that VSWR drops below the desirable maximum value "2" in the 2.4G–2.6 GHz frequency band and in the 5.1 G–5.9 GHz frequency band, indicating acceptable efficient operation in these two wide frequency bands, which cover more than the total bandwidth of nearly all protocols or standards of short-range wireless communications, for example, 802.11a/b/g, 802.15 (Bluetooth), HomeRF, and so on.

Referring to FIGS. 3–8, note that each radiation pattern is close to a corresponding optimal radiation pattern and there is no obvious radiating blind area, conforming to the practical use conditions of an antenna.

The multi-band antenna 1 of the present invention is made of sheet metal so that it is strong enough to pass the panel vibrational test of a notebook computer easily. Furthermore, the size and weight of the present invention are small enough to adapt to the trend of miniaturization of portable terminals.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-band antenna used in an electronic device for electrically connecting with a feeder cable, comprising:

a ground portion comprising a fixing section and a ground section;

a first radiating arm being positioned above the ground section and comprising a bent end;

a second radiating arm extending from the first radiating arm and forming at least one bent portion;

a connecting portion connecting the first and the second radiating arms with the ground portion; and a feeding point being arranged on the connecting portion;

wherein the ground portion, the connecting portion, the first and the second radiating arms and the feeder cable form at least two inverted-F antennas operating in different frequency bands.

2. The multi-band antenna as claimed in claim 1, wherein the ground portion has a Z-shaped configuration.

3. The multi-band antenna as claimed in claim 1, wherein the fixing section comprises a horizontal plane and a vertical plane extending from said horizontal plane.

4. The multi-band antenna as claimed in claim 1, wherein the fixing section defines a screw hole for fixing the antenna on the electronic device.

5. The multi-band antenna as claimed in claim 1, wherein the first radiating arm is L-shaped.

6. The multi-band antenna as claimed in claim 1, wherein the second radiating arm is U-shaped.

7. The multi-band antenna as claimed in claim 1, wherein the first and the second radiating arms are coplanar with each other.

8. The multi-band antenna as claimed in claim 1, wherein the first and the second radiating arms form a rectangular open loop, the open loop defining a gap in a corner thereof.

9. The multi-band antenna as claimed in claim 1, wherein the connecting portion is step-shaped and is perpendicular to the ground section.

10. A multi-band antenna for an electronic device, comprising:

a ground portion;

a first radiating arm having a bent end;

a second radiating arm extending from the first radiating arm to the bent end of the first radiating arm;

a connecting portion perpendicular to the ground portion and interconnecting the first and the second radiating arms with the ground portion; and a feeding point being defined on the connecting portion.

11. The multi-band antenna as claimed in claim 10, wherein the antenna is formed of an integral sheet metal.

12. The multi-band antenna as claimed in claim 10, wherein the ground portion comprises a fixing section and a ground section.

13. The multi-band antenna as claimed in claim 12, wherein the fixing section comprises a horizontal plane substantially coplanar with the first radiating arm.

14. The multi-band antenna as claimed in claim 13, wherein the fixing section comprises a vertical plane extending from said horizontal plane.

15. The multi-band antenna as claimed in claim 12, wherein the fixing section defines a through hole for fixing the antenna in the electronic device.

16. The multi-band antenna as claimed in claim 12, wherein the first and the second radiating arms are coplanar with each other and positioned parallelly above the ground section.

17. The multi-band antenna as claimed in claim 12, wherein the first and the second radiating arms cooperatively form an open loop, the open loop defining a gap adjacent to the fixing section of the ground portion.

18. A multi-band antenna assembly for an electronic device, comprising:

a ground portion defining a first plane;

a radiating trace essentially located on a second plane spaced from said first plane in a parallel relation, said radiating trace being an open loop manner;

a connecting portion connected between the radiating trace and the ground portion, and dividing the radiating trace into first and second radiating arms; and a feeding point being defined on the connecting portion.

19. The antenna as claimed in claim 18, wherein said connection portion defines a third plane perpendicular to both said first and second planes.

20. The antenna as claimed in claim 18, wherein the connection portion is of a step-like configuration with three segments thereof.

21. The antenna as claimed in claim 20, wherein said three segments include upper and lower segments respectively connected to the radiating trace and the grounding portion, and a middle segment connecting said upper and lower segments.

22. The antenna as claimed in claim 21, wherein said middle segment extends in a direction parallel to said first and second planes.

23. The antenna as claimed in claim 18, wherein said radiating trace including a plurality to bent segments each defining a plane extending perpendicular to said first and second planes.

* * * * *